US006622494B1

(12) United States Patent
Pourrahimi

(10) Patent No.: US 6,622,494 B1
(45) Date of Patent: Sep. 23, 2003

(54) SUPERCONDUCTING APPARATUS AND COOLING METHODS

(75) Inventor: Shahin Pourrahimi, Brookline, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 09/661,921

(22) Filed: Sep. 14, 2000

Related U.S. Application Data

(63) Continuation of application No. PCT/US99/21545, filed on Sep. 14, 1999.
(60) Provisional application No. 60/100,177, filed on Sep. 14, 1998.

(51) Int. Cl.[7] ..... F25B 19/00; F25D 23/12
(52) U.S. Cl. ..... 62/51.1; 62/259.2
(58) Field of Search ..... 62/51.1, 259.2

(56) References Cited

U.S. PATENT DOCUMENTS

| | | | | |
|---|---|---|---|---|
| 3,639,672 A | * | 2/1972 | Kafka | 174/125.1 |
| 3,800,414 A | * | 4/1974 | Shattes et al. | 29/599 |
| 3,950,606 A | * | 4/1976 | Schmidt | 174/11 R |
| 4,568,900 A | * | 2/1986 | Agatsuma et al. | 174/15.5 |
| 4,578,962 A | * | 4/1986 | Dustmann | 310/54 |
| 4,857,675 A | * | 8/1989 | Marancik et al. | 174/125.1 |
| 5,410,286 A | * | 4/1995 | Herd et al. | 335/216 |
| 5,419,142 A | | 5/1995 | Good | |
| 5,513,498 A | | 5/1996 | Ackermann et al. | |
| 5,615,557 A | | 4/1997 | Binneberg et al. | |
| 6,110,606 A | * | 8/2000 | Scudiere et al. | 428/629 |

FOREIGN PATENT DOCUMENTS

GB 2148474 A 5/1985

OTHER PUBLICATIONS

Taylor et al "Coils for the Superconducting Levitron", Lawrence Radiation Laboratory, University of California, Livermore California 94550.*

Taylor et al "The Livermore Superconducting Levitron", Lawrence Radiation Laboratory, University of California, Livermore California 94550.*

Clyde E. Taylor et al., "The Livermore Superconducting Levitron" Lawrence Radiation Laboratory, U. of California, Livermore, California 94550.

Clyde E. Taylor and Thomas J. Duffy, "Coils for the Superconducting Levitron" Lawrence Radiation Laboratory, U. of California, Livermore, California 94550.

Joes H. Schultz et al., "The Levitated Dipole Experiment (LDX) Magnet System" Superconductivity Conference; Palm Desert, CA, Sep. 14–18, 1998.

* cited by examiner

*Primary Examiner*—William C. Doerrler
(74) *Attorney, Agent, or Firm*—Wolf, Greenfield & Sacks, P.C.

(57) ABSTRACT

The current invention provides, in some embodiments, superconducting cryostat apparatuses, and methods for containing a coolant within the apparatuses and for cooling the apparatuses. The superconducting apparatuses provided by the invention include a self-contained supply of a coolant medium, which can be provided in the form of a pressurized gas. The mass of the coolant medium contained in the apparatus is conserved during operation of the apparatus. The superconducting cryostat apparatuses provided by the invention can be configured, in some embodiments, to eliminate the need for sources of external cooling during operation. The superconducting cryostat apparatuses provided by the invention can be cooled by supplying one or more sealable containers within the apparatuses with a quantity of cooling medium in gaseous form, and sealing the sealable containers. The cooling cooling medium is subsequently cooled to below the critical superconducting temperature of the superconductors contained within the apparatus via indirect cooling with an external heat exchange medium. In some embodiments, the external heat exchange medium can be maintained in essentially continuous contact with the superconducting cryostat apparatus during operation, and in other embodiments, once the superconducting cryostat apparatus has been cooled to below the superconducting temperature of the superconductors contained therein, the external heat exchange medium can be removed and the superconducting cryostat apparatus can be operated independently of the external heat exchange medium.

19 Claims, 6 Drawing Sheets

SUPERCONDUCTING APPARATUS AND COOLING METHODS

This application is a continuation of International Patent Application No. PCT/US99/21545, filed Sep. 14, 1999, which claims priority to 60/100,177, filed Sep. 14, 1998.

FIELD OF THE INVENTION

The present invention relates to superconducting systems including superconductors, such as superconducting wires or cables, including those configured as superconducting magnets, and cooling systems to maintain the temperature of the superconductors below its critical temperature.

BACKGROUND OF THE INVENTION

Superconductors are phases that exhibit extremely low (essentially zero) electrical resistance below their critical temperature and critical magnetic field. Superconducting wires and cables have been used in a variety of applications, predominantly in superconducting electromagnetic magnets in which a superconductor is wound into a coil. Superconducting magnets have been used in applications including, for example, devices used for nuclear magnetic resonance (NMR) spectroscopy, magnetic resonance imaging (MRI), superconducting magnetic energy storage (SMES) and magnetic mine sweeping, as disclosed in, for example, *Superconducting Magnets*, M. N. Wilson, Oxford University Press, New York, N.Y. (1983) and *Case Studies in Superconducting Magnets*, Y. Iwasa, Plenum Press, New York, N.Y. (1994).

Known superconductors must be cooled to be made superconducting.and must be kept cool to remain superconducting, for example, in most typical prior art systems in a bath of liquid helium is used for cooling. A typical superconducting systems such as a superconducting magnet system, will include a coil form (e.g. a mandrel or bobbin) around which is wrapped a number of windings of cable or wire constructed of superconducting materials. Typical superconducting materials employed for such systems include Type II superconductors as defined in J. K. Hulm and B. T. Matthias, *Superconductor Material Science*, edited by S. Foner and B. B. Schwartz, Plenum Press, New York, N.Y., 1981, pp.37–53 such as superconductors including $Nb_3Sn$-, $Nb_3Al$-, and $V_3Ga$-based compounds, and typically employed superconductors typically have critical temperatures below about 80 K and more commonly below about 40 K or even below about 20 K. In addition, the systems typically include vessels, within which the superconducting elements are placed. Often these vessels also utilize a liquid coolant, for example liquid helium, for cooling and maintaining the superconducting elements below their critical temperature for operation. Such vessels are hereinafter referred to as cryostats.

Typical prior art superconducting cryostat systems are operated using an external source of refrigeration which provides cooling power either to make liquid helium or other liquid gases or cold gas mixtures around the superconductors. In many systems, the helium is typically first cooled and liquefied to below the critical temperature of the superconductors and then introduced to the system. But these systems have several disadvantages. One is that they must have the ability to vent helium gas from the cryostat as heat is removed by converting the liquid helium into a gas; otherwise, the systems would pose an explosion danger. This venting of helium requires the systems to have a ready source of supplemental helium during operation, and also entails a considerable waste of helium, which is relatively expensive.

Cooling arrangements for superconducting systems have been proposed that do not involve a net loss of cooling fluid, such as helium. U.S. Pat. No. 5,419,142 to Good discloses such a system useful for providing back-up cooling of a cryostat in the event of a loss of the main refrigeration system, for example due to a power failure. The system disclosed by Good includes an external source of helium gas in fluid communication with a cryostat apparatus, containing a superconducting magnet, via a connection line including a special two-directional valve.

Cooling arrangements for superconducting systems involving sealed cryostats, which contain an essentially constant mass of cooling fluid during operation, have also been disclosed. Taylor et al. describe such a system, including a floating-ring superconducting magnet apparatus which has an internal volume, containing the superconducting wires on a coil form, which can be pressurized with helium gas and permanently sealed (Taylor et al. "Coils for the Superconducting Levitron," *Proceedings of Symposium on Engineering Problems of Fusion Research*, January, 1970; Taylor et al. "The Livermore Superconducting Levitron" *Proceedings of Symposium on Engineering Problems of Fusion Research*, January, 1970). The helium gas can then be cooled to a temperature below the superconducting temperature for the superconducting components. In the system described by Taylor et al., however, the vessel containing the superconducting components includes both the superconducting wire and the coil form and comprises a highly stressed, internally pressurized shell, which shell would typically need to be constructed to have a relatively thick wall thickness and/or be formed from materials of construction that are extremely. strong, and typically very expensive, in order to withstand the coolant gas pressures required.

While the system disclosed by Good can reduce the waste of helium and can enhance operating safety and enable the system to function for a time in the event of a loss of external refrigeration, and while the systems described by Taylor et al. can provide a sealed, constant mass superconducting magnet cryostat, there is still a need in the art for simple and inexpensive cryostat systems including superconductors that can reduce the waste of cooling medium, provide increased economy, simplicity and portability, and increase operational safety and flexibility.

SUMMARY OF THE INVENTION

The current invention involves novel superconducting cryostat apparatuses and methods for cooling superconducting cryostat apparatuses. The superconducting apparatuses according to the invention include a self-contained supply of a coolant medium. The mass of the coolant medium contained in an apparatus is conserved during operation. Thus, the superconducting apparatuses provided according to the invention can essentially eliminate the loss of cooling medium during operation. The inventive superconducting apparatuses also can eliminate the need for sources of external cooling during operation. The inventive apparatuses can thus be constructed to have lower operation and construction costs than typical prior art superconducting systems. The novel superconducting apparatuses provided by the invention can also have enhanced simplicity of operation and enhanced portability compared to typical prior art superconducting systems. The superconducting apparatuses provided according to the invention can be supplied with a quantity of cooling medium in gaseous form and at room temperature that is subsequently cooled to below the critical superconducting temperature of the superconductors contained within the apparatus via indirect cooling prior to operation of the apparatus. In some embodiments, once an apparatus has been cooled via indirect cooling, there is no subsequent need for external cooling during operation of the apparatus.

In one aspect, a superconducting cryostat apparatus is provided comprising a vessel, and at least one superconducting component including at least one superconductor contained within the vessel. The apparatus further includes at least one sealable container that is separate from the vessel containing the superconducting component, and that is in thermal communication with the superconductor. The sealable container has an internal volume that is able to contain a coolant. The sealable container, when containing the coolant, is able to maintain the superconductor at a temperature not exceeding its critical temperature during operation of the apparatus.

In another embodiment, a superconducting apparatus comprising a vessel and at least one superconductor contained within the vessel is provided. The superconducting apparatus further includes a heat absorption system including at least one sealable container that is separate from the vessel containing the superconductor. The apparatus requires no external source of cooling during operation of the apparatus.

In another embodiment, a superconducting cryostat apparatus is provided. The apparatus includes at least one superconducting component including at least one superconductor. The apparatus further includes at least one sealable container that is coiled and that has an internal volume containing at least one superconducting component. The internal volume is able to contain a coolant. The sealable container, when containing the coolant, is able to maintain the superconductor at a temperature not exceeding its critical temperature during operation of the apparatus.

In yet another embodiment, a superconducting cryostat apparatus comprising at least one superconducting wire, cable, or ribbon is provided. The apparatus further includes a sealable container having an internal volume, containing the superconducting wire, cable, or ribbon, and further providing void space about the superconducting wire, cable, or ribbon able to contain a coolant. The container forms a conduit around the superconducting wire, cable or ribbon such that a cross-sectional plane perpendicular to a longitudinal axis of the container intersects the superconducting wire, cable, or ribbon at only a single point along its length.

In another embodiment, a superconducting cryostat apparatus comprising at least one superconducting wire, cable, or ribbon coiled to form a winding pack is provided. The winding pack has a minimum external cross-sectional dimension of a first value. The apparatus further includes a sealable container. The sealable container has a minimum internal cross-sectional dimension of a second value that is less than the first value. The sealable container also has an internal volume able to contain a coolant. The sealable container, when containing the coolant, is able to maintain the superconducting wire, cable, or ribbon at a temperature not exceeding its critical temperature during operation of the apparatus.

In yet another embodiment, a superconducting cryostat apparatus comprising at least one superconducting wire, cable, or ribbon is provided. The apparatus further includes a sealable container. The sealable container has an internal volume able to contain a coolant that has a maximum internal diameter not exceeding 3 inches. The sealable container, when containing the coolant, is able to maintain the superconducting wire, cable, or ribbon at a temperature not exceeding its critical temperature during operation of the apparatus.

In another aspect, the invention provides a series of methods. One embodiment involves a method comprising introducing a mass of gas into at least one sealable container that is contained within a superconducting cryostat apparatus that includes at least one superconductor. The container is separate from a vessel containing the superconductor, and the gas has a temperature exceeding a critical temperature of the superconductor. The method further includes sealing the container after introduction of the gas.

Another embodiment provides a method comprising providing at least one sealable container having an internal volume containing at least one superconducting component including at least one superconductor, where the sealable container is coiled. The method further includes introducing a mass of gas into the sealable container, where the gas has a temperature exceeding a critical temperature of the superconductor, and then sealing the container.

Other advantages, novel features, and objects of the invention will become apparent from the following detailed description of the invention when considered in conjunction with the accompanying drawings, which are schematic and which are not intended to be drawn to scale. In the figures, each identical or nearly identical component that is illustrated in various figures is represented by a single numeral. For purposes of clarity, not every component is labeled in every figure.

DETAILED DESCRIPTION OF THE INVENTION

Figure 1:
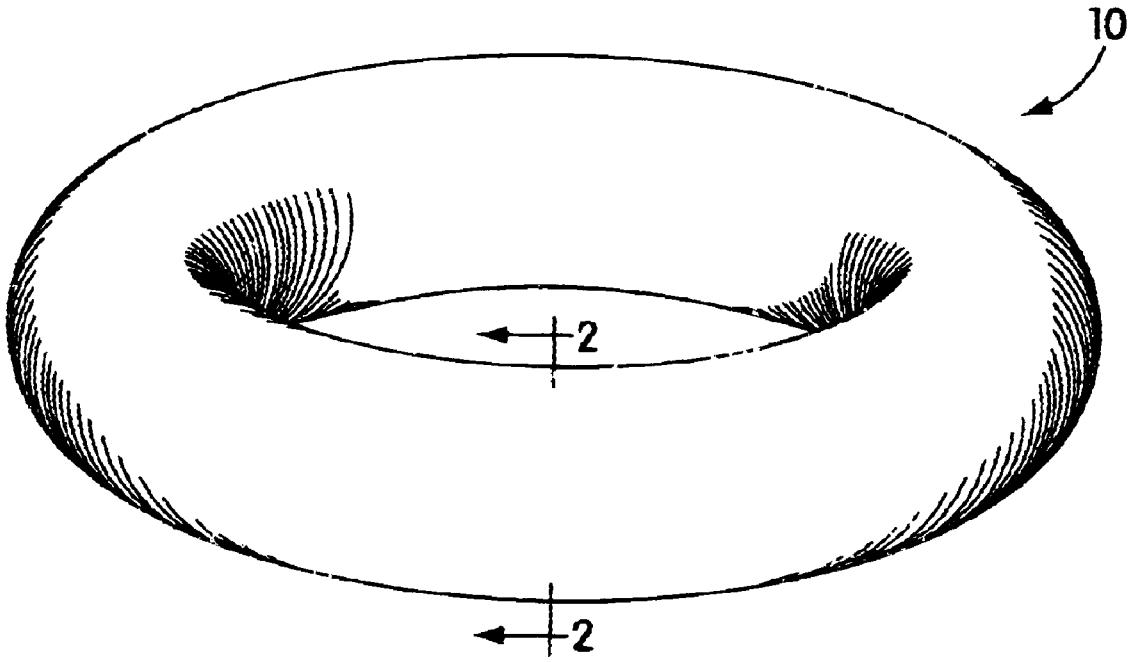
FIG. 1 is a schematic illustration of a self contained toroidally shaped superconducting cryostat apparatus according to one embodiment of the invention.

The present invention provides novel superconducting cryostat apparatuses and methods for cooling the apparatuses and keeping the apparatuses cool. "Cooling" or to "cool" as used herein refers both to the process of reducing a temperature of an apparatus or object(s) therein as well as to maintaining the apparatus or object(s) at a reduced temperature below that of its surroundings. The apparatuses and methods provided by the current invention solve many of the deficiencies of the prior art by providing apparatuses, including one or more superconducting elements or components, that include one or more sealable containers, constructed to contain a cooling medium for cooling the superconducting components. A "sealable container" as used herein refers to a container or vessel having an internal volume that initially can communicate with the external surroundings so that a mass of cooling medium, such as a compressed gas, can be added to the internal volume, and which can then be subsequently sealed to prevent mass transfer to or from the container (i.e. to maintain a constant mass of cooling medium within the container), thus preventing the loss of cooling medium to the surroundings. In some embodiments, the cryostat comprises a single container that also contains the superconducting components of the apparatus so that the cooling medium is in direct fluid contact with the superconducting components, whereas in other embodiments, the sealable containers within the apparatus, which are constructed and arranged to contain a constant mass of cooling medium during operation, are separate from the vessel containing the superconducting components but are in thermal communication with (e.g. at least partial contact with) one or more surfaces of the vessel containing the superconducting components, or with the superconducting components themselves in order to enable sufficient heat exchange to cool the superconducting elements to a temperature below their critical temperature. "Separate from the vessel containing the superconducting components" or "separate sealable containers," as used above in the context of certain embodiments for sealable containers containing cooling medium, refers to sealable containers that are included in the overall apparatus but whose internal enclosed volume does not contain the superconducting components, i.e. the internal volume of the sealable container(s) is sealed to passage of any coolant to or from the internal volume of the vessel containing the superconducting components.

"Operation" of the apparatus, as used herein, refers to creating and maintaining a superconducting current through at least one superconducting component in the apparatus. "Thermal communication" as used herein in regard to components of the inventive apparatus, refers to two or more components that are constructed, and arranged with respect to each other, so that there can be a relatively rapid rate of heat transfer between the elements. Such thermal communication, in some embodiments, can be enabled by arranging the components within the apparatus so that there is direct physical contact between one or more heat conductive surfaces, for example metal surfaces, on each component. Alternatively, thermal communication may be established by indirect contact between components (e.g. through an intermediate heat conducting components) or by convective or radiative heat transfer between components within the apparatus. For embodiments involving sealable containers, for containing a cooling medium, that are "separate" from the vessel containing the superconducting components (i.e. have an internal volume not containing the superconducting components, as described and defined above), the cooling medium itself is not in direct physical contact with any superconducting components.

As used herein, the term "superconductor" refers to a Type II superconductor as defined in J. K. Hulm and B. T. Matthias, *Superconductor Material Science*, edited by S. Foner and B. B. Schwartz, Plenum Press, New York, N.Y., 1981, pp.37–53. The "critical temperature" of a superconductor herein refers to the maximum temperature below which the material can remain a superconductor. "Superconducting component" or "superconducting element" as used herein refers to an element or component of the apparatus that includes a superconductor. Such elements and components can include one or more of superconducting wires, superconducting cables, superconducting ribbons, and superconducting magnets constructed therefrom. The superconducting components can further include additional, non-superconducting components, for example, support wires, electrical insulation, etc. as apparent to those of ordinary skill in the art.

The "superconducting cryostat apparatus" or "superconducting apparatus" as used herein includes one or more superconducting components contained within a vessel, and further includes a system to absorb heat from the superconducting components and/or from the surroundings that is defined by, integral with, contained within, and/or non-detached from, the vessel containing the superconducting components.

One embodiment for a sealable container for use in a system to absorb heat from the superconducting components comprises a volumetric container enclosing an internal volume that can be closed to prevent mass transfer between the internal volume and the outside of the container (e.g. to prevent loss of contents once filled). Sealable containers that are potentially useful within the context of the present invention can include pressure vessels, such as volumetric chambers or tubing, having at least one closable valve or sealable port for mass transfer communication with an external source of cooling medium. Once filled with cooling medium and either reversibly or permanently sealed, the sealable containers, according to the present invention, advantageously contain an essentially constant mass of cooling fluid throughout the operation of the superconducting apparatus thus preventing loss of cooling fluid and eliminating the need for an external supply of cooling fluid to the apparatus during operation.

A "cooling medium" or "coolant" as used herein refers to a mass of gas used as a heat capacitor for absorption of heat generated either by the superconducting components during operation or transferred to the vessel housing the superconducting components from the external environment or both. A "gas" as used herein in the context of the cooling medium refers to the thermodynamic phase of the cooling medium at ambient or room temperature; the cooling medium may, however, undergo phase changes upon cooling to a desired operating temperature and may be present as essentially any phase including a gas, liquid, solid, supercritical fluid, or mixtures thereof in the superconducting cryostat apparatus after cooling. The cooling medium should be capable of being cooled to a temperature below the critical temperature of the superconducting elements in the apparatus, and the medium also preferably has a relatively high heat capacity at that temperature. As described in more detail below, in preferred embodiments, the cooling medium is introduced to the apparatus as a compressed gas at essentially ambient temperature. A particularly preferred cooling medium for use in the invention is gaseous helium (He) or gaseous mixtures containing He as a component.

The inventive superconducting cryostat apparatuses and superconducting apparatuses according to the invention enable novel and advantageous methods for providing cooling to superconducting components for maintaining the operating temperature of such components below the critical temperature of the superconducting material from which they are fabricated. "Operating temperature" as used herein refers to the temperature of the superconducting components of the superconducting apparatus during operation. The operating temperature must be maintained below the critical temperature of the superconductors to allow for superconductance. A preferred method of providing cooling according to the invention involves first introducing a mass of cooling medium, preferably in gaseous form, into one or more sealable containers within the superconducting apparatus. After a desired quantity of cooling medium is introduced, the container is sealed, for example by means of a valve or a sealable port, to prevent any additional mass transfer or loss of cooling medium. The container and cooling medium are then cooled to a temperature below the critical temperature (typically 4–60 K) of the superconducting components of the apparatus by indirect cooling via an indirect cooling medium. "Indirect cooling" as used herein refers to cooling brought about by temporary or continuous contact or exposure of a heat conducting surface, such as a metal surface, which is in thermal communication with the sealable container(s) containing the cooling medium, to an external mechanism that acts as a source of heat removal. Such heat removal can be accomplished in some embodiments by thermal communication, for example by surface to surface contact, between an external surface or a portion of the external surface of a sealable container(s) containing the cooling medium and a heat exchanger or heat exchange medium external to the apparatus. A variety of known external heat exchangers or heat exchange mediums known in the art can be employed for this purpose including, but not limited to, cryogenic heat exchangers or Joule-Thompson effect heat exchangers. Once the cooling medium contained within the sealable container(s) in the superconducting cryostat apparatus is brought to below the critical superconducting temperature, the external source of cooling can be removed, if desired, and the operation of the superconducting components can commence free of the need for continuous external cooling. In other embodiments, especially where portability and separability of the superconducting cryostat apparatus is not critical, the external source of cooling can be maintained in contact with the apparatus during operation to provide essentially continuous heat removal from the cooling medium. In effect, for embodiments where the external source of cooling is removed from the apparatus after cooling but before operation, the constant mass of cooling medium contained within the sealable container(s) in the superconducting cryostat apparatus, once cooled, can act in a manner analogous to an ice pack in a cooler: absorbing heat from the superconducting components and surroundings while maintaining a temperature below the critical superconducting temperature for a finite time period of operation of the superconducting components.

For embodiments where the external source of cooling is removed prior to operation of the apparatus, the actual efficiency of the cooling effect and the time that the apparatus, once cooled, can maintain the temperature of the superconductors below the critical temperature depends on many factors including the mass and composition of cooling medium added to the apparatus, the amount of heat generated by the superconducting components during operation, the overall heat transfer coefficient for heat transfer between the superconducting components and the cooling medium, the heat absorbed by the apparatus from the surroundings (which depends on the degree of insulation of the vessel), the temperature and phase of the cooling medium after cooling and the before beginning operation of the superconducting components, etc. All of these factors can be optimized for a given system using standard experimental techniques, calculation procedures, and physical property data known to those skilled in the art. Reasonable systems can be designed, for example, that can enable superconductor operation on a single cooling charge (i.e. operation without addition of cooling medium to the sealable container (s) or exposure of the apparatus to an external source of cooling after an initial cooling) of at least one hour, more preferably at least 10 hrs and even more preferably in excess of a day or more. Once the temperature in the apparatus rises above a pre-determined temperature (e.g. a temperature at or somewhat below the critical temperature for the superconductor being used), the cooling medium can simply be re-cooled via a subsequent indirect cooling step. During actual operation, the inventive apparatuses can be operated, in some embodiments, so that it requires no source of external cooling and are essentially self-contained, allowing an exceptional degree of flexibility and portability for the apparatuses. Once charged with coolant and subsequently cooled, the inventive apparatus, with proper insulation, can be designed to maintain a temperature below the critical superconducting temperature for an extended period prior to operation and during operation, potentially allowing such apparatus to be relatively easily transported in a charged (and, in some embodiments, cooled) condition for use under field conditions, for example where access to refrigeration or cryogenic cooling is not available. As discussed above, in many applications, it may be preferred that the external source of cooling be maintained in essentially continuous contact with the external cooling medium. In such applications the heat removal capacity of the external source of cooling is available to extract heat from the superconducting system which may be generated as a result of transient conditions such as A.C. losses in the superconducting system. It should be emphasized that external sources of cooling employed for use with the inventive superconducting cryostat apparatuses even when maintained in essentially continuous contact with the apparatus need not supply cooling medium to, or exchange cooling medium with, the sealable container(s) containing cooling medium within the apparatus.

For preferred embodiments, the cooling medium is introduced to the sealable container(s) of the apparatus as a gas. Such gas is preferably introduced under pressure. The pressure of the gas is preferably greater than 1 atm, and most preferably at least 100 atm. The higher the pressure of gas introduced, the greater the mass of gas, and, therefore, the greater the heat capacity. The cooling medium can be introduced to the apparatus at any desired temperature. For convenience, it is preferred to add the cooling medium at a temperature above the critical superconducting temperature of the superconducting components of the apparatus, most preferably the cooling medium is introduced at room temperature. It is generally not necessary to remove so much heat during the indirect cooling step of the inventive method to liquefy a cooling medium introduced to the apparatus as a pressurized gas, although for certain embodiments, where the external source of cooling is not in contact with the apparatus during operation and which require long operating periods between coolings, this may be desirable. While a preferred gaseous cooling medium for use in the invention is helium, it may also be advantageous to add other gases (e.g. nitrogen) to the helium in some embodiments, which gases can solidify upon charging thus forming a two-phase cooling medium after cooling. Such a two-phase mixture can have a significantly higher capacity for heat absorption over a given temperature range due to latent heat effects of phase transition. It should be pointed out that the inventive superconducting cryostat apparatuses not only reduce consumption and loss of cooling medium, and allow for flexible and portable operation, but also are characterized by potentially improved safety. Since the sealable containers that contain the cooling medium must be designed to contain the gaseous cooling medium at ambient temperature, there is no danger of explosion or system damage if the temperature in the apparatus exceeds the quenching temperature of the superconducting components during operation as with some prior art systems. In addition, as discussed in more detail below, several of the embodiments for providing sealable containers for containing pressurized gas utilize containers having a relatively small internal diameter, for example tubing, which enables such containers to be fabricated having relatively thin walls and from relatively inexpensive materials, thus providing improved economy and lower cost in comparison to typical superconducting cryostat apparatuses.

While it should be understood that the inventive superconducting cryostat apparatuses and cooling methods can be configured in a wide variety of ways and operated for a wide variety of applications, and that the particular configuration will vary according to the particular requirements of a particular application as would be apparent to those skilled in the art, below are described, for illustrative purposes, several exemplary apparatuses in order to point out particular features of some embodiments of the invention. One exemplary embodiment of a superconducting cryostat apparatus 10 according to the invention is shown on FIG. 1. The embodiment shown in FIG. 1 illustrates a completely contained superconducting cryostat apparatus requiring essentially no direct material or electrical communication. In the illustrated embodiment, the superconducting components, wound as coils within the toroidally shaped cryostat apparatus, are made superconducting through inductive charging. Such an apparatus, as illustrated, could be used as part of a levitating superconducting magnet system with its own built-in self-contained cryostat cooling system. Such a stand-alone, self contained system is not possible to fabricate using most typical prior art cryogenic cooling systems that require the use of an external source of cooling medium during operation. In other embodiments, not illustrated, the superconducting cryostat apparatus may be different in form or shape, may be designed for essentially continuous contact with an external heat exchange medium during operation, may be utilized for different purposes than illustrated, and may be attached in direct electrical communication with one or more power supplies, instead of being inductively powered as illustrated.

Figure 2A:
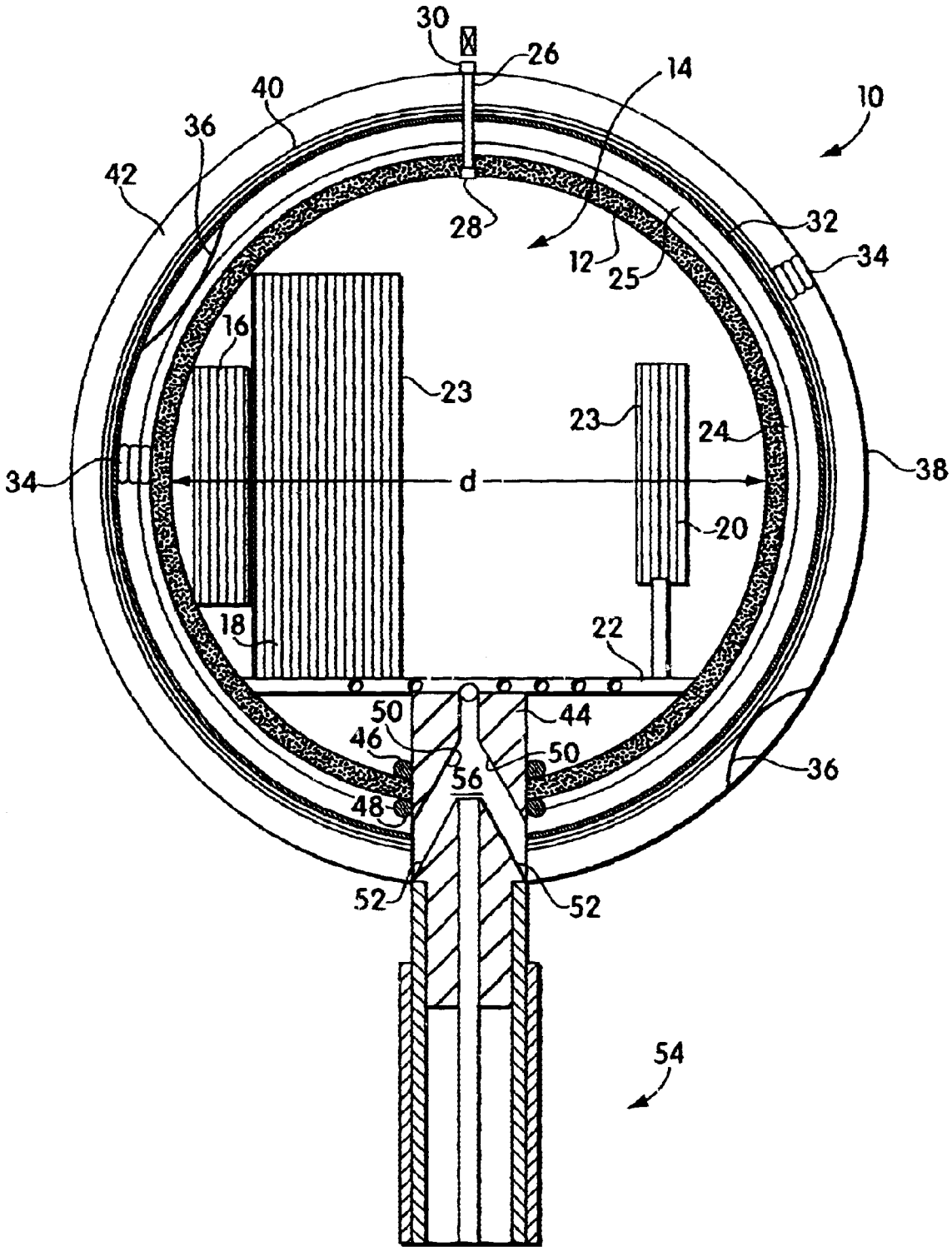
FIG. 2*a* is a cross sectional view of a superconducting cryostat apparatus through line 2—2 of FIG. 1 showing one embodiment for providing a sealable container for containing pressurized coolant.

A cross-sectional view of a first embodiment of the arrangement of the internal components of the superconducting cryostat apparatus 10 is illustrated in FIG. 2*a*. The embodiment shown in FIG. 2*a* illustrates a superconducting cryostat apparatus 10 design including a sealable container 12 having an internal volume 14 that contains a constant mass of a cooling medium during operation of the apparatus and that also encloses and contains the entirety of the coiled superconducting components, which may be coiled into winding packs 16, 18, and 20 upon one or more mandrels or coil forms (not shown), as well as a platform 22 on which the winding packs are supported. A "winding pack" as used herein refers a coil of superconducting components (e.g. superconducting wire(s), cable(s), or ribbon(s)), which may or may not be supported by a mandrel or coil form. A "winding pack" as used herein possesses the shape and dimensions of the entire coil of superconducting components, which shape and dimensions include any mandrel or coil form upon which the superconducting components may be coiled, as well as any void space between individual windings of the superconducting components or defining an annular region around which the superconducting components are coiled. As explained in more detail below, because sealable container 12 surrounds and encloses the entirety of the coiled superconducting components as well as their coil forms (together comprising winding packs 16, 18, and 20) and platform 22, the internal diameter d may be required, in some embodiments to be relatively large, having a minimum internal cross-sectional dimension greater than the maximum external cross-sectional dimensions of the winding packs contained therein (e.g. greater than 1 ft. in many embodiments). Such an arrangement typically requires the sealable container 12 to comprise a relatively thick walled vessel or be fabricated from especially strong and typically expensive materials. According, the arrangement shown in FIG. 2*a* not ideally suited for scale-up for use in systems requiring a relatively large internal diameter vessel 12 (e.g. internal diameter greater than about one foot) for containing the superconducting and other components.

As illustrated, the superconducting components are comprised of a plurality of windings of individual superconducting wires, or cables constructed therefrom, coiled to form winding packs 16, 18, and 20 supported by platform 22. Such a construction is typical for fabricating some superconducting magnets. In the illustrated embodiment, the cooling medium, once introduced to the sealable vessel 12, is in direct physical contact with the external surfaces 23 of the winding packs 16, 18, 20 containing the superconducting wires, and with platform 22. Because the individual superconducting cables or wires in the winding packs are typically very tightly wound, the coolant is typically not able to be in direct physical contact with each of the individual superconducting windings or wires. Accordingly, the illustrated system is better suited to direct current (D.C.) operation where alternating current (A.C.) losses and the resulting heat generation by the system components is low.

In alternative embodiments, discussed in more detail below in reference to FIGS. 2*b*, 2*c*, and 2*d*, the apparatus can include one or more sealable containers, which contain the cooling medium, that are separate from the vessel 12 containing the superconducting components. For example, the sealable containers may be separate containers that can be placed inside the volume 14 containing the superconducting components and arranged so that the cooling medium is in thermal communication, but not direct physical contact, with the superconducting components. Alternatively, the sealable containers could be placed outside the volume 14 containing the superconducting components but in direct physical contact with, or in thermal communication with, the vessel 12 containing the superconducting components. In one particular alternative embodiment, the sealable container containing the cooling medium could comprise a chamber defined by a hollow concentric shell (e.g. 24 or 25 in FIG. 2) adjacent to the vessel 12 containing the superconducting components. For some embodiments involving sealable coolant medium containers that are separate from the volume 14 containing the superconducting components, the sealable containers are preferably placed within and/or external to but in direct physical contact with the vessel 12 containing the superconducting components, or alternatively, can be placed in direct physical contact with the superconducting components, so that the coolant medium can absorb a substantial fraction of the heat generated by operation of the superconducting components and/or by heat transfer into the apparatus from the external surroundings. "Absorb a substantial fraction of the heat" as used herein, refers to the ability of the cooling medium to remove and uptake (e.g. by sensible heat changes of the cooling medium and/or latent heat effects due to phase changes of one or more components of the cooling medium) sufficient heat energy from the superconducting components and/or surroundings during operation to provide an operating temperature of the superconducting components that is below the critical superconducting temperature. Those of ordinary skill in the art will be able to readily determine how to construct and arrange the sealable containers taught by the present invention so that they are able to absorb a substantial fraction of the heat generated by operation of the superconducting components and/or by heat transfer into a particular apparatus from the external surroundings utilizing the principles of heat transfer, thermodynamics, and superconductor behavior known to those of ordinary skill in the art.

Referring again specifically to the embodiment shown if FIG. 2*a*, vessel 12 comprises a pressure vessel capable of withstanding high gas pressures (e.g. in excess of 100 atm). Vessel 12 is preferably constructed from a strong durable metal material, such as steel, Inconel, titanium, or other strong durable material as apparent to those of ordinary skill in the art. Vessel 12 includes at least one high pressure gas inlet port 26, which communicates with interior volume 14 at orifice 28. Port 26 includes a sealable inlet connection 30 for attachment to a high pressure source of coolant gas, for example helium. Apparatus 10 also can include several concentric layers around vessel 12 which serve as thermal insulation. In some embodiments, layer 32 can comprise a lead shield. Lead shield 32 acts as a thermal shield by retarding heat transfer from the external surroundings into the internal volume 14 of the vessel 12. Lead is particularly advantageous for this purpose because it has the highest heat capacity of any technical solid. The lead shield 32 is separated from and supported by vessel 12 via a plurality of spacers 34. Spacers 34 may be solid or hollow objects, such as spheres, which are constructed of glass surrounded by Inconel, or another preferably thermally insulating material, or alternatively may be constructed as springs. To prevent damage by mechanical shock, vessel 12 and thermal shield 32 can also be separated by a plurality of resilient bumpers 36 to absorb impact shock. The thermal shield layer 32 can be further surrounded by an outermost shell 38. Outermost shell 38 may be constructed from a variety of suitable materials, such as metals, for example stainless steel, as apparent to the skilled artisan. Outer shell 38 can be separated from and supported by thermal shield 32 using spacers 34 and bumpers 36.

The space between vessel 12 and thermal shield 32 can be filled with one or more layers (e.g. 24, 25) of insulation. Insulation layers can be comprised of any suitable insulating material apparent to the skilled artisan. Some insulation materials for use in the invention can include Mylar superinsulation. The space between thermal shield 32 and outermost shell 38 can also be similarly insulated with one or more layers of insulation (e.g. 40, 42). Alternatively, or additionally, the spaces separating vessel 12, thermal shield 32, and outermost shell 38 can be placed under vacuum in order to reduce heat transfer through the layers via heat conduction through gas.

FIG. 2*a* also shows one embodiment of apparatus 10 that enables indirect cooling of the mass of coolant gas contained within sealable container 12 after charging the vessel 12 with coolant gas via port 26 and prior to operation of the superconducting components. In the illustrated embodiment, platform 22 includes an attached component 44, constructed from a material that has a high heat conductivity, that is sealingly welded by welds on the inside 46 and outside 48 of an aperture in sealable container 12 so that it remains sealable from the surroundings. Component 44 is in direct contact (and thus thermal communication) with vessel 12, the cooling medium in volume 14, and the superconducting components. Component 44, as shown, becomes an integral part of sealable container 12 providing an external surfaces 50 that are shaped an configured to mate with complementary heat transfer surfaces 52 of an external heat exchange medium 54 which is used for indirect cooling of the cooling medium contained in apparatus 10. As previously mentioned, external heat exchange medium 54 may be any variety of suitable heat exchangers, cryogenic coolers, etc. known in the art. When indirectly cooling the cooling medium in apparatus 10, heat exchange medium 54 would be situated so that surfaces 52 are in direct physical contact with complementary external surfaces 50 of sealable container 12. The heat exchange medium 54 would be kept in contact at least until the temperature of the constant mass of cooling medium in sealable container 12 is at a desired temperature below the critical temperature of the superconductor, whereupon, external heat exchange medium 54 could be removed from contact with apparatus 10, and cavity 56 could be covered or sealed with suitable insulation. Apparatus 10 would then be ready for operation for an extended period without further need for any sources of cooling external to apparatus 10. For embodiments where apparatus 10 is operated while not in contact with external heat exchange medium 54, eventually, the cooling medium will warm up to a temperature greater than that required for stable operation of the superconductor. However, unlike typical prior art systems, pressure relief of the cooling medium and addition of additional cooling medium to the apparatus 10 is not required either after the temperature rises above a desired pre-determined maximum value for operation or between operations of the apparatus. Rather, all that is required is that between consecutive operations of the apparatus, the constant mass of cooling medium still contained in sealable container 12, be re-cooled by indirect cooling with external heat exchange medium 54. This can significantly reduce the complexity, and fabrication and operating costs of the inventive apparatus when compared to many prior art systems.

It should be emphasized that the embodiment in FIG. 2*a* represents only one possible configuration for indirectly cooling vessel 12 with an external source of cooling 54. A variety of other suitable configurations for creating thermal communication between sealable container 12, containing the constant mass of cooling medium, and an external source of cooling may be contemplated by the skilled artisan for indirectly cooling the cooling medium in the apparatus. All such possible alternative configurations fall within the scope of the present invention. As just one example, instead of the configuration shown in FIG. 2*a*, the apparatus could include a plurality of heat exchangers with welded penetrations through the sealable vessel containing the cooling medium. Such an apparatus could be indirectly cooled by circulating liquid helium through the heat exchangers and subsequently draining the liquid helium from the heat exchangers prior to operation of the apparatus.

As discussed above, for applications involving superconducting apparatuses including superconducting components and other components contained therein, which require a vessel containing such components to have an internal diameter that is relatively large (e.g., >1 ft), the wall thickness and strength of the vessel that is required to contain a high pressure coolant gas can make fabrication of such an apparatus expensive and impractical. For embodiments requiring a relatively large (e.g., internal diameter >1 ft) containment vessel surrounding the winding pack(s) and any support platform(s), it is preferred that the sealable container(s) for containing the coolant not contain the entirety of the winding pack(s) and platform, so that the internal diameter of the sealable container(s) can be substantially independent of the overall size of the winding pack(s)/platform(s) that are contained within the vessel, specifically, the minimum internal cross-sectional dimension of the sealable containers can be less than the minimum external cross-sectional dimension of any winding pack(s) included in the system.

An important reason why a sealable container having a relatively small internal diameter is preferred for certain applications, as described above, is that the wall thickness and material strength required of such a sealable container can be much less than for a sealable container having a larger internal diameter, thus permitting sealable containers having relatively small internal diameters to be fabricated from thin wall materials that can reduce the overall weight and cost of the superconducting cryostat apparatus. In order to withstand a given internal pressure, sealable containers or vessels having a relatively small internal diameter can be constructed from materials having a thinner wall thickness and lower overall strength than larger diameter vessels because the hoop stress on such vessels scales with the size of the vessel according to the simple relation $\sigma \cong P(r/t)$, for $r>10t$ ("thin-walled" pressure vessel). Where a is the hoop stress, P is the vessel internal pressure, t is the vessel wall thickness, and r is the inner radius of the vessel. For example, many superconducting cryostat apparatuses for use in superconducting magnet applications require a vessel that surrounds the superconducting magnet components to have an inner radius of between about 20 to 100 inches. Pressurizing a 20 inch inner radius vessel with coolant gas at 100 atmospheres would require an extremely thick vessel wall thickness. For example, if the vessel is made of 304 stainless steel, the wall thickness would need to be at least 1.5 inches thick, which may be unreasonable owing to cost and weight considerations. Alternatively, stronger materials, such as titanium or other high strength metals, may be used, but such materials add cost and complexity, and the vessel wall thickness required and overall weight may still be prohibitively large.

Figure 2B:
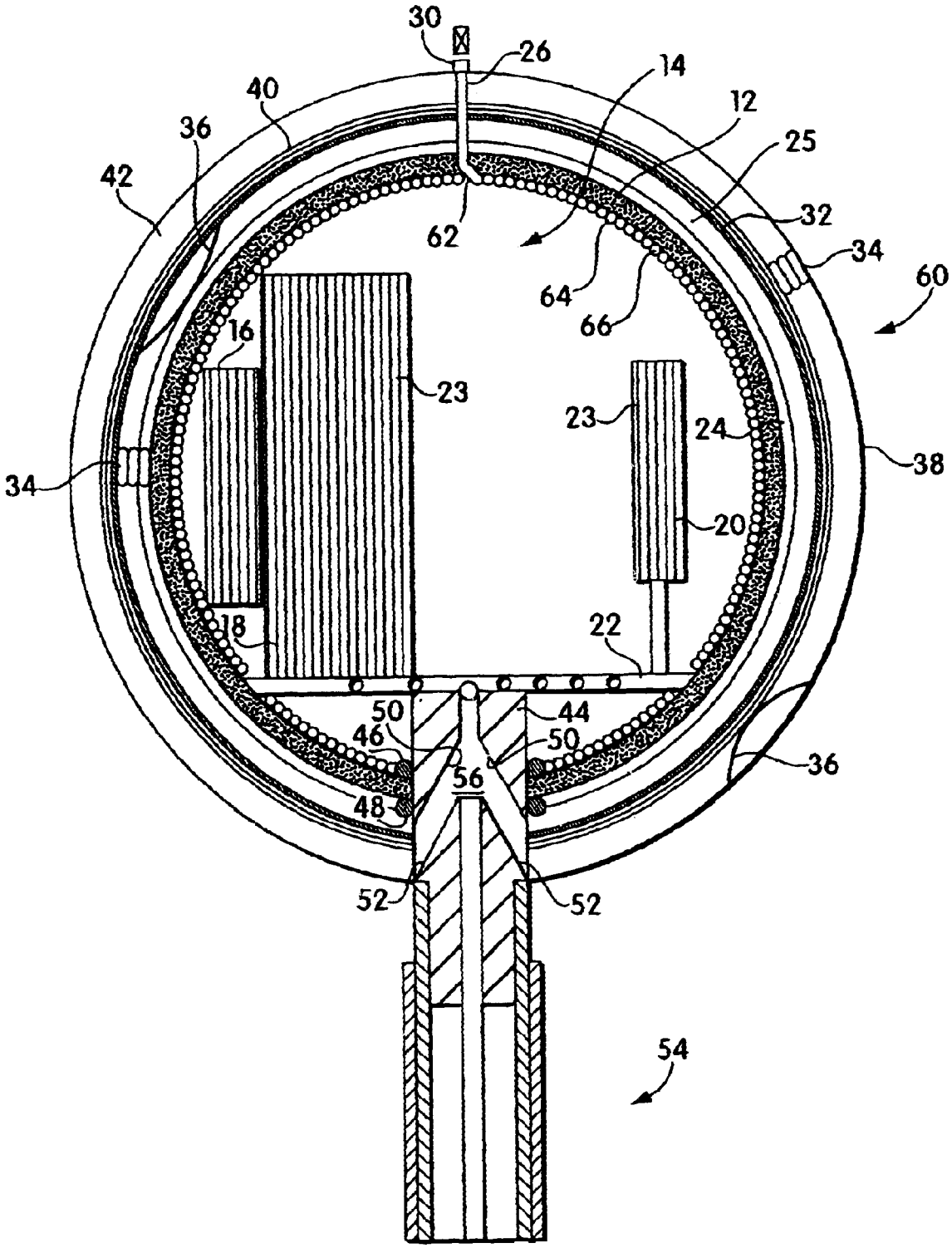
FIG. 2*b* is a cross sectional view of a superconducting cryostat apparatus through line 2—2 of FIG. 1 showing a second embodiment for providing a sealable container for containing pressurized coolant.

One preferred embodiment for providing separate sealable containers for cooling the superconducting cryostat apparatus of FIG. 1 is shown in FIG. 2*b*. The configuration for superconducting cryostat apparatus 60 shown in FIG. 2*b* is similar to that shown previously in FIG. 2*a*, except that vessel 12 surrounding and containing winding packs 16, 18, and 20 and platform 22 no longer comprises the sealable container for containing the high pressure coolant gas. Rather, the high pressure coolant gas is contained in a sealable container 62 formed of tubing located inside vessel 12 and in direct physical contact with an internal surface thereof. In the illustrated embodiment, the separate sealable container 62 is formed of a length of tubing that is coiled within vessel 12 to form a plurality of windings 64 extending along the axial direction of torroidally-shaped vessel 12. Each winding 64 has an internal volume 66, which contains the pressurized coolant.

Because the tubing comprising separate sealable container 62 has an internal crosssectional diameter that is much smaller than that of vessel 12, sealable container 62 can be constructed from thin-walled, relatively inexpensive materials. For example, sealable container 62 can be constructed from commercially available stainless steel tubing having a 1 inch internal diameter and with a wall thickness of, for example, 0.065 inch. Such tubing can be safely filled with high pressure coolant gas up to pressures of about 170 atmospheres. For other configurations, the equation given above relating the hoop stress of a pressure vessel to the internal pressure, internal radius, and wall thickness can be utilized to select appropriate materials and dimensions for the sealable containers for use in the invention. In general, the sealable containers provided according to the present invention for containing a cooling medium can have maximum internal diameters in some embodiments not exceeding 3 inches, in other embodiments not exceeding 2 inches, and in yet other embodiments not exceeding 1 inch. Furthermore, since vessel 12 is no longer required to contain high pressure coolant gas, the wall thickness, strength, cost, and weight of vessel 12 can be substantially reduced, when compared to the embodiment shown above in FIG. 2*a*.

In the embodiment illustrated in FIG. 2*b*, sealable container 62, formed from thin-walled tubing, comprises a single continuous length of tubing with one end connected to inlet 26 and sealable inlet connection 30 to facilitate attachment to a high pressure source of coolant gas, and its other end (not shown) sealed so that the tubing can contain an essentially constant mass of coolant gas during operation of the apparatus. In other embodiments, however, it should be understood that sealable container 62 may be comprised of a plurality of interconnected lengths of thin-walled tubing. In yet other embodiments, a plurality of separate, non-interconnected, lengths of thin-walled tubing may be utilized to provide a plurality of separate sealable containers, each having a sealed end and an end connected to an inlet port for charging with high pressure coolant gas. Sealable container 62, in other embodiments, may have multiple inlet ports and/or may have a terminal end which is not permanently sealed but which includes a valve thereon, so that coolant gas may be continuously flowed through the thin-walled tubing as well as being sealed therewithin.

Individual windings 64 of the thin-walled tubing comprising separate sealable container 62 are, in preferred embodiments, rigidly attached to vessel 12 in order to prevent displacement of the windings and to improve heat transfer between the surface of the thin-walled tubing and vessel 12. For example, windings 64 of sealable container 62 may be welded to the internal surface of vessel 12. It should also be emphasized that while a single layer of windings 64 is shown, in other embodiments, depending on the amount of heat which needs to be absorbed by the coolant system, multiple layers of windings could alternatively be utilized, or a substantial fraction of interior volume 14 of vessel 12 could be occupied by the thin-walled tubing comprising separate sealable container 62. Also, instead of being wound parallel to the axial direction of torroidal vessel 12, alternatively, the thin-walled tubing comprising the separate sealable container could be wound so that the windings of the tubing are oriented circumferentially about the axial direction of torroidal vessel 12 (i.e. oriented essentially perpendicular to the direction shown). In short, those of ordinary skill in the art will readily envision a variety of ways of arranging and configuring the thin-walled tubing comprising the separate sealable container(s) in order to facilitate heat absorption by the coolant system depending on the needs of a particular application. All such alternative arrangements and configurations are considered to be within the scope of the present invention.

Figure 2C:
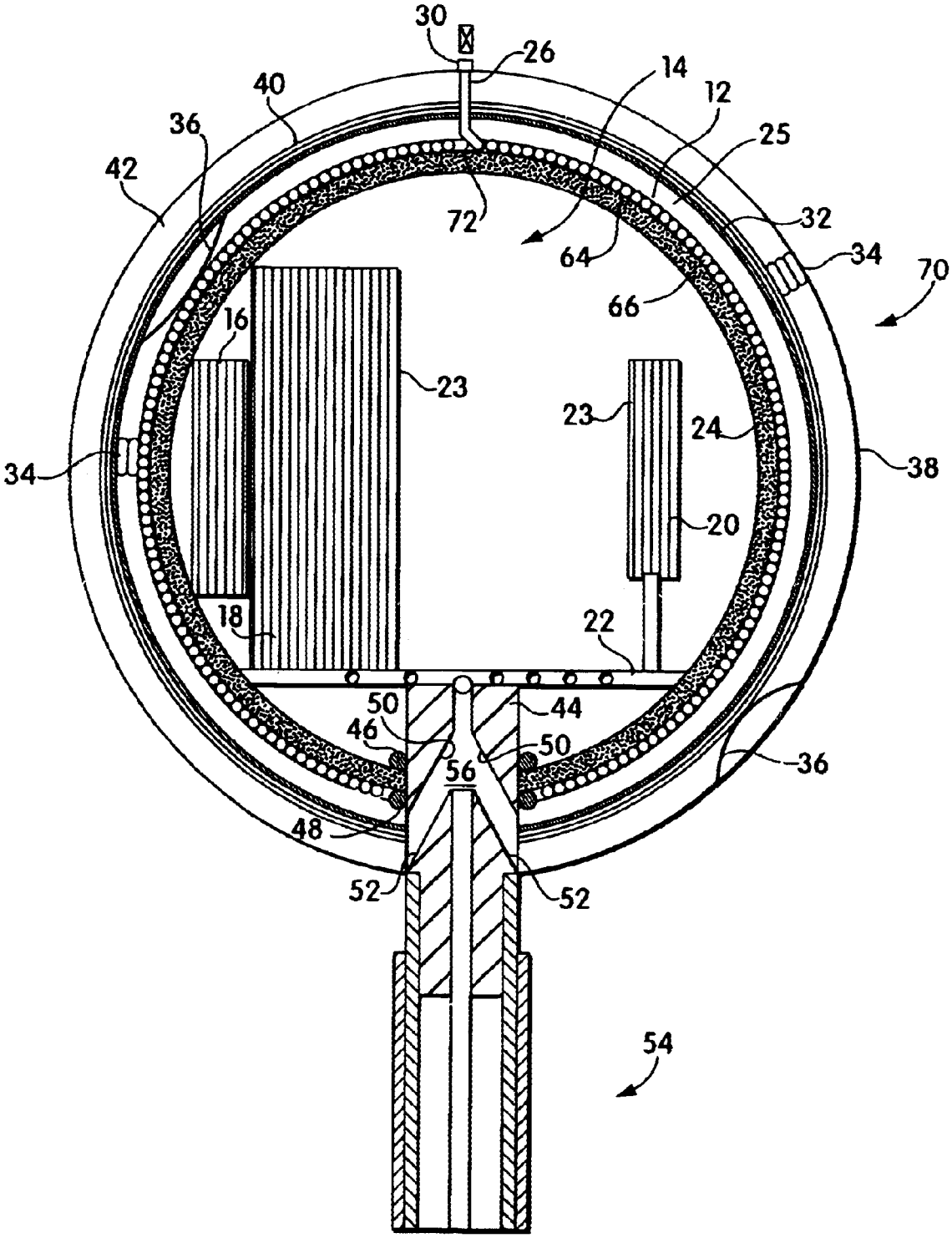
FIG. 2*c* is a cross sectional view of a superconducting cryostat apparatus through line 2—2 of FIG. 1 showing a third embodiment for providing a sealable container for containing pressurized coolant.

FIG. 2*c* illustrates an alternative embodiment for providing a separate sealable container fabricated from thin-walled tubing. The configuration shown by the embodiment of FIG. 2*c* is similar to that shown above in FIG. 2*b* except that superconducting cryostat apparatus 70 includes a separate sealable container 72 that is formed of thin-walled tubing coiled to form a plurality of windings 64 in contact with the external surface of vessel 12.

Figure 2D:
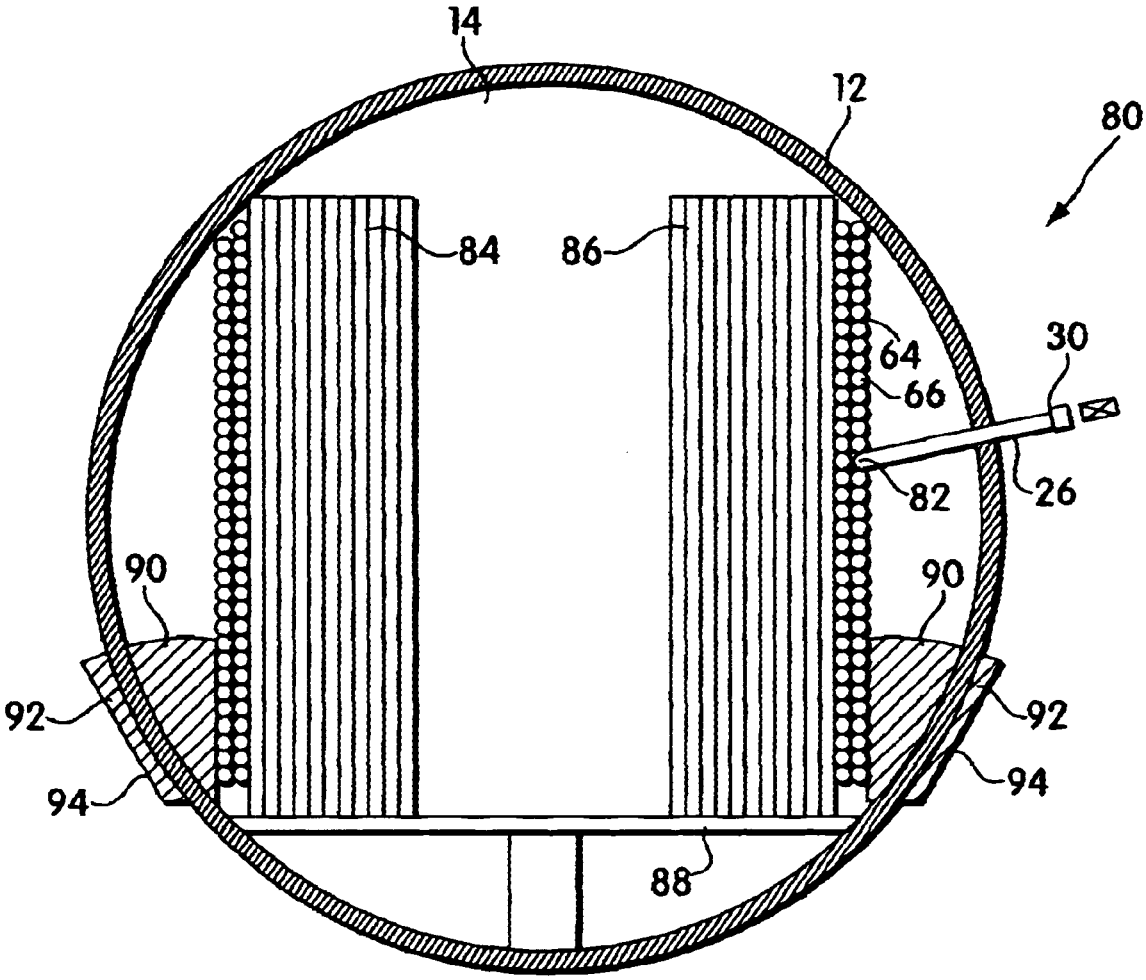
FIG. 2*d* is a cross sectional view of a superconducting cryostat apparatus through line 2—2 of FIG. 1 showing a fourth embodiment for providing a sealable container for containing pressurized coolant.

Another alternative embodiment for arranging the separate sealable container(s) to absorb heat from a superconducting cryostat apparatus, such as shown in FIG. 1, is illustrated by superconducting cryostat apparatus 80 shown in FIG. 2*d*. Apparatus 80 is shown in FIG. 2*d* without illustrating the various insulating layers and supporting components, illustrated previously in FIGS. 2*a*–2*c*, for simplicity; however, it should be understood that such additional components can also be included in apparatus 80 in order to reduce heat losses and improve the operating stability of the apparatus.

The cooling system of apparatus 80 is provided by sealable container 82, which is formed of thin-walled tubing similar to the embodiments shown in FIG. 2*b* and FIG. 2*c*. In the current embodiment, instead of arranging the tubing comprising the separate sealable container so that it is adjacent to, and in contact with, vessel 12, the tubing comprising sealable container 82 is coiled into a plurality of windings 64, at least a portion of which are in direct physical contact with winding packs 84 and 86, which contain the superconducting components, such as superconducting wires, platform 88. In the illustrated embodiment, windings 64 of the tubing comprising separate sealable container 82 form two layers in direct physical contact with winding packs 84, 86; however, as would be understood by those of ordinary skill in the art, the number of layers of windings may be varied depending upon, for example, the quantity of heat needed to be removed from the system, the temperature and composition of the coolant being used, the total volume of coolant required, etc.

For embodiments where the sealable container(s) are in direct physical contact with the superconducting components of the cryostat apparatus (as in the embodiment shown in FIG. 2*d*) the sealable containers and the superconducting components should be electrically isolated from each other, for example by providing one or more layers of electrical insulating material surrounding the sealable container(s) and/or the superconducting components, or by providing a layer of insulating material disposed adjacent to the surface of the superconducting components in contact with the sealable container(s). Preferably, such an electrically insulating layer will be fabricated of a material that has a heat transfer coefficient and/or has a thickness selected so as to not unduly inhibit the rate of heat transfer between the sealable container(s) and the superconducting components.

Superconducting cryostat apparatus 80 also illustrates an alternative embodiment for enabling indirect cooling of the mass of coolant gas contained within sealable container 82. In the illustrated embodiment, vessel 12 includes heat transfer components 90, which are in direct physical contact with both the interior surface of vessel 12 and separate sealable container 82. In contact with, and preferably attached to, the outside surface of vessel 12 at a position adjacent to heat transfer components 90 are cooling blocks 92 each providing a cooling interface 94 that is shaped and configured to mate with a complementary heat transfer surface of an external heat exchange medium (not shown) which is used for indirect cooling of the coolant medium contained in apparatus 80, as previously described. Heat exchange components 90, 92 are preferably constructed from a material that has a high heat conductivity. While, in the illustrated embodiment, two heat transfer components and cooling interfaces are provided, it should be understood that in alternative embodiments a single component and interface could be employed or, alternatively, more than two such components and interfaces could be employed.

In the above-described embodiments, while the sealed container was comprised of tubing, or various sections of tubing, it should be understood that in alternative embodiments, the cooling medium may be contained in a number of discrete, individually isolated or fluidically interconnected, relatively small containers, such as hollow balls or cylinders, which are contained within and/or located outside and in contact with the vessel containing the superconducting components in a manner similar or analogous to that described for the above embodiments.

In a number of superconductor applications, for example a number of superconducting magnet applications, the superconducting wire or cable used to form the coiled windings is exposed to a time-varying magnetic field. Such exposure results in what is often referred to as "A.C. losses" (see for example *Super Conducting Magnets*, M. N. Wilson, Oxford University Press, New York, Chapter 8, 1983). Such A.C. losses can cause substantial heat generation by the superconducting system components. In many such applications, it is preferred for the superconducting wires or cables comprising the coiled windings to be in direct contact with coolant to enable more effective and faster cooling of the superconducting components. In yet another aspect, the present invention provides a superconducting cryostat apparatus including a sealable container for containing coolant, which container is designed to substantially increase the area of contact between the superconducting components, such as superconducting wire or cable, and the coolant medium. In one such embodiment, the invention provides a sealable container which forms a conduit surrounding the superconducting wires or cables, which conduit can be filled with pressurized cooling gas and sealed and can further be coiled into a winding pack, for example on a coil form, for the fabrication of a superconducting magnet. A "conduit" as used herein refers to an elongated container having a longitudinal axis, and having a perimeter that envelops and encloses the superconducting wires, cables, ribbons, etc. contained therein so that a cross-sectional plane perpendicular to the longitudinal axis of the conduit intersects each of the superconducting wires, cables, ribbons, etc. at only a single point along the entire length of the superconducting wires, cables, ribbons, etc. contained therein. In regions where the conduit is strait, the longitudinal axis will be parallel to the line defining the axial centerline of the conduit, and in regions where the conduit may be curved, the longitudinal axis is defined as a line tangent to the curve defining the longitudinal direction of the center of the conduit at a chosen point along the curved length.

Figure 3A:
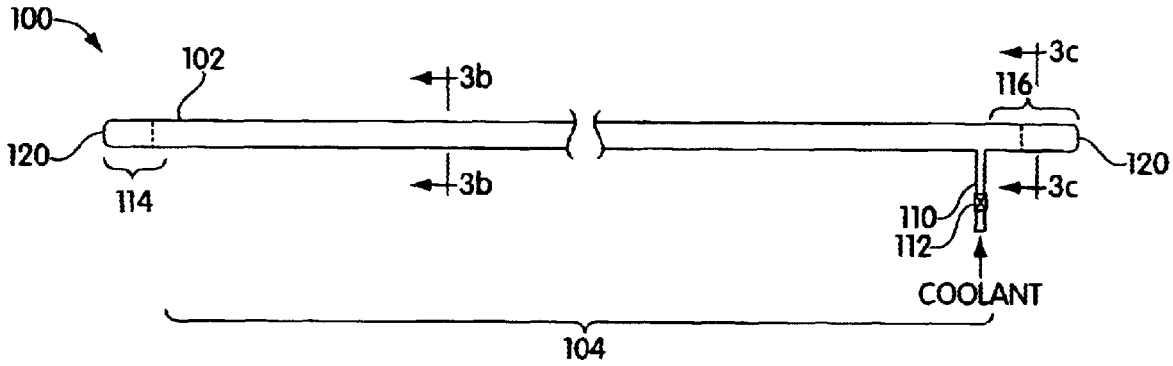
FIG. 3*a* is a schematic illustration of a sealable conduit enclosing a plurality of superconducting wires.
Figure 3B:
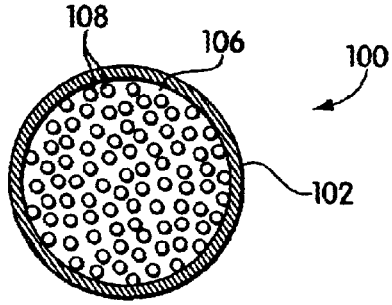
FIG. 3*b* is a first cross sectional view through line b—b of the sealable conduit of FIG. 3*a*.
Figure 3C:
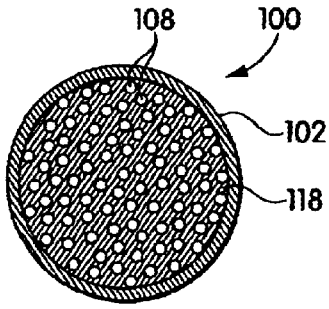
FIG. 3*c* is a second cross sectional view through line c—c of the sealable conduit of FIG. 3*a*.

An embodiment of a sealable container configured as a conduit surrounding a plurality of superconducting wires is shown in FIGS. 3*a*–3*c*. Sealable container 100 shown in FIG. 3*a* comprises an elongated, and preferably tubular, conduit or sheath 102 surrounding one or more continuous lengths of superconducting wire, cable or ribbon. Conduit 102 includes a central portion 104, comprising the bulk of its overall length, which includes a hollow internal volume 106 (seen more clearly in FIG. 3*b*), which is partially filled with superconducting wires 108. Conduit 102 further includes at least one port 110 therein which is in fluid communication with internal volume 106 and is sealable, for example via closing of valve 112, thus permitting internal volume 106 to be filled with a pressurized coolant gas from an external source, subsequently sealed, and cooled by indirect cooling, as previously described. In alternative embodiments, conduit 102 can include more than one port for fluid communication with the environment. Also, in other embodiments, instead of employing a valve 112, the port may be permanently or reversibly sealed by other means, for example by plugging, welding, pinching, etc. Conduit 102 further includes end regions 114, 116 wherein the internal space surrounding the superconducting wires is filled with a solid, fluid impermeable material 118 in order to form a pressure tight seal at each end of sealable container 100 (seen most clearly in FIG. 3*c*). As described in more detail below, in preferred embodiments, solid material 118 is an electrically conductive material, such as a metal (e.g., a metal solder), in order to facilitate electrical connection of ends 114, 116 to a power supply or to each other to form an electric circuit. A variety of metals and other materials may be utilized as solid material 118, as apparent to those of ordinary skill in the art. Preferred materials have good electrical conductivity, are compatible with the materials forming superconducting wires 108 and conduit 102, and are capable of forming a pressure tight seal at fluid pressures of at least 100 atmospheres.

As described above, in some embodiments, sealable container 100, including superconducting wires 108, will be coiled into a plurality of windings to form one or, more winding packs, for example in the fabrication of a superconducting magnet. In just one possible example, a superconducting cryostat apparatus can be constructed utilizing sealable container 100, which apparatus is similar in construction to that shown previously in FIG. 2*d*. In such an embodiment, sealable container 100, containing superconducting wires 108, could be used to form the windings of winding packs 84, 86, and sealable container 82, shown previously in FIG. 2*d*, could be eliminated. In addition, heat transfer components 90 would be configured so that they are in direct physical contact with the winding packs formed of coiled conduit 102.

For applications where conduit 102 of sealable container 100 is coiled into a plurality of windings, it is important that central region 104 of conduit 102 include a layer of electrical insulation, preferably on its external surface to prevent shorting between adjacent windings of conduit 102 that are in physical contact with each other. Also, as described previously, the ends of conduit 102 should be electrically conductive and be in electrical communication with superconducting wires 108. Referring to FIG. 3*a*, conduit 102 preferably has terminal ends 120 that do not include an electrical insulating layer and which are in electrical communication with superconducting wires 108 and solid material 118 within conduit 102. Terminal ends 120 of conduit 102 may be attached to a power supply configured to drive electrical current through superconducting wires 108, or, in alternative embodiments (for example in embodiments involving an inductively driven superconducting magnet) the two terminal ends may be connected one to the other in order to complete an electrically conducting loop.

Sealable container 100 has several advantages for forming a superconducting cryostat apparatus, when compared to the embodiments described above in FIGS. 2*a*–2*d*. First, because the diameter of conduit 102 needs only be large enough to accommodate a single winding of superconducting wires 108, or superconducting cable, the internal diameter and wall thickness of the sealable container, and thus its weight and cost, can be substantially decreased when compared to the embodiment of a sealable container shown in FIG. 2*a*. For example, in one typical embodiment, conduit 102 would contain between about 27 to 1000 individual superconducting wires and would have an internal diameter within the range of about 0.1–1 inch. In such embodiments, commercially available stainless steel thin-walled tubing, similar to that described previously for the embodiments shown in FIGS. 2*b*–2*d*, could be utilized as conduit 102. Alternatively, conduit 102 could be made from other rigid metals or materials, as apparent to those of ordinary skill in the art. In certain embodiments, when conduit 102 is fabricated tubing constructed from steel or a steel alloy, conductive ends 120 of the conduit can be formed of a metal having superior electrical conductance in comparison with steel; for example, ends 120 can be fabricated of copper and/or Monel®. Conductive ends 120 can be incorporated into and fused with the steel-containing portion of conduit 102 using a variety of techniques well known in the art.

Another advantage provided by sealable container 100 is that superconducting cryostat apparatuses fabricated using sealable container 100 can have a substantially improved ability to remove any heat generated by the superconducting system components during operation. Such heat removal capability can be particularly important for system operation involving high A.C. losses. Sealable container 100 facilitates efficient heat absorption from the superconducting components of the system at least in part because conduit 102, which can surround each individual winding of superconducting wire or cable forming, for example, a superconducting magnet, can provide substantially increased surface area for contact between a coolant gas contained within internal volume 106 and the superconducting components. For example, sealable container 100, as shown in FIG. 3*b*, allows the coolant gas contained in internal volume 106 to have direct physical contact with essentially each individual superconducting wire included in the system. By contrast, in the previous embodiments illustrated (e.g., those shown in FIGS. 2*a*–2*d*) the coolant was either not in direct contact with the superconducting components (FIGS. 2*b*–2*d*) or was in contact only with an outer surface of the winding pack of coiled superconducting wire (FIG. 2*a*), which outer surface comprises only a small fraction of the total surface area of the individual superconducting wires therein.

Having thus described certain embodiments of the present invention, various alterations, modifications and improvements will be obvious to those of ordinary skill in the art. Such alterations, modifications and improvements are intended to be within the scope of the present invention. Accordingly, the above description is meant by way of example only and is not intended to be limiting. The present invention is limited only by the claims listed below and equivalents thereto.

What is claimed is:

1. A superconducting cryostat apparatus comprising:

at least one superconducting component including at least one superconductor;

at least one sealable container that is coiled and that has an internal volume containing at least one superconducting component, said internal volume able to contain a coolant, where the at least one sealable container, when containing said coolant, is able to maintain said superconductor at a temperature not exceeding its critical temperature during operation of the apparatus.

2. The apparatus of claim 1, wherein said coolant is a gas.

3. The apparatus of claim 2, wherein said gas comprises helium.

4. The apparatus of claim 2, wherein said gas comprises a mixture of gasses, said mixture including helium.

5. The apparatus of claim 1, wherein said at least one superconducting component is in direct physical contact with said coolant.

6. The apparatus of claim 1, wherein said at least one sealable container comprises tubing.

7. The apparatus of claim 6, wherein said tubing is coiled around a coil form.

8. The apparatus of claim 6, wherein said tubing has an internal diameter no greater than 3 inches.

9. The apparatus of claim 8, wherein said tubing has an internal diameter no greater than 1 inch.

10. The apparatus of claim 1, wherein said sealable container has an internal volume that contains at least one superconducting wire, cable, or ribbon.

11. The apparatus of claim 1, wherein said at least one sealable container is able to absorb a substantial fraction of the heat generated by said apparatus and input to said apparatus.

12. The apparatus of claim 1, further including an external heat exchange medium for indirectly cooling said mass of a coolant from a temperature above the critical temperature of said superconductor to a temperature not exceeding said critical temperature.

13. The apparatus of claim 12, wherein said external heat exchange medium is a heat exchange medium shaped and positionable to be placed in contact with a surface that is in thermal communication with said at least one sealable container during cooling of said mass of coolant from a temperature above the critical temperature of said superconductor to a temperature not exceeding said critical temperature.

14. The apparatus of claim 12, wherein the apparatus requires no external source of cooling during operation of the apparatus for operating durations of at least one hour.

15. A superconducting cryostat apparatus comprising:

at least one superconducting wire, cable, or ribbon; and a sealable container, said sealable container having an internal volume able to contain a coolant and having a maximum internal diameter not exceeding 3 inches, with said sealable container, when said coolant, being able to maintain said superconducting wire, cable, or ribbon at a temperature not exceeding its critical temperature during operation of the apparatus.

16. The superconducting cryostat apparatus of claim 15, wherein said sealable container has a maximum internal diameter not exceeding 1 inch.

17. The superconducting cryostat apparatus of claim 15, wherein said sealable container comprises tubing.

18. The superconducting cryostat apparatus of claim 17, wherein said tubing forms a conduit around said at least one superconducting wire, cable, or ribbon.

19. The superconducting cryostat apparatus of claim 15, wherein said sealable container is separate from a vessel having an internal volume containing said at least one superconducting wire, cable, or ribbon.

* * * * *

UNITED STATES PATENT AND TRADEMARK OFFICE

CERTIFICATE OF CORRECTION

PATENT NO. : 6,622,494 B1 
DATED : September 23, 2003
INVENTOR(S) : Shahin Pourrahimi It is certified that error appears in the above-identified patent and that said Letters Patent is hereby corrected as shown below:

Column 1,
Line 1, in the first paragraph of the text of the patent, please add:
-- This invention was made with government support under Grant Number DE-FG02-98ER54458 awarded by the Department of Energy. The government has certain rights in the invention. --

Signed and Sealed this

Thirtieth Day of December, 2003

JAMES E. ROGAN
*Director of the United States Patent and Trademark Office*